US011271315B2

(12) United States Patent
Onaka et al.

(10) Patent No.: US 11,271,315 B2
(45) Date of Patent: Mar. 8, 2022

(54) ANTENNA MODULE AND COMMUNICATION DEVICE

(71) Applicant: Murata Manufacturing Co., Ltd., Kyoto (JP)

(72) Inventors: Kengo Onaka, Kyoto (JP); Yoshiki Yamada, Kyoto (JP); Keiichi Hirose, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 57 days.

(21) Appl. No.: 16/818,339

(22) Filed: Mar. 13, 2020

(65) Prior Publication Data

US 2020/0220270 A1 Jul. 9, 2020

Related U.S. Application Data

(63) Continuation of application No. PCT/JP2018/028180, filed on Jul. 27, 2018.

(30) Foreign Application Priority Data

Sep. 14, 2017 (JP) ..... JP2017-176596

(51) Int. Cl.
*H01Q 1/38* (2006.01)
*H01Q 9/04* (2006.01)
(Continued)

(52) U.S. Cl.
CPC ..... *H01Q 9/045* (2013.01); *H01Q 1/2208* (2013.01); *H01Q 1/422* (2013.01)

(58) Field of Classification Search
CPC ..... H01Q 9/045; H01Q 1/2208; H01Q 1/422; H01Q 1/241
See application file for complete search history.

(56) References Cited

U.S. PATENT DOCUMENTS 6,147,648 A 11/2000 Granholm et al.
2003/0214368 A1* 11/2003 Taniguchi ..... H03H 9/725 333/133
(Continued)

FOREIGN PATENT DOCUMENTS

CN 103179779 A 6/2013
JP 2000-508144 A 6/2000
(Continued)

OTHER PUBLICATIONS

International Search Report issued in Patent Application No. PCT/JP2018/028180 dated Oct. 16, 2018.
(Continued)

*Primary Examiner* — Dieu Hien T Duong
(74) *Attorney, Agent, or Firm* — Pearne & Gordon LLP

(57) ABSTRACT

An antenna module includes a multilayer substrate having a first main surface and a second main surface opposing to each other, a patch antenna formed on a side of the first main surface of the multilayer substrate and configured with a radiation electrode and a ground electrode, an RFIC formed on a side of the second main surface of the multilayer substrate, a first filter, and a second filter different from the first filter, wherein the patch antenna has a first feed point and a second feed point provided at different positions in the radiation electrode, the first feed point is electrically connected to the RFIC via the first filter, the second feed point is electrically connected to the RFIC via the second filter, and the first filter and the second filter are formed in the multilayer substrate.

20 Claims, 10 Drawing Sheets

(51) Int. Cl.
*H01Q 1/22* (2006.01)
*H01Q 1/42* (2006.01)

(56) References Cited

U.S. PATENT DOCUMENTS

| | | | | |
|---|---|---|---|---|
| 2006/0055601 | A1 | 3/2006 | Kameda et al. | |
| 2013/0162367 | A1 | 6/2013 | Tanaka et al. | |
| 2016/0036128 | A1* | 2/2016 | Werner | H01Q 9/045 343/850 |
| 2018/0098324 | A1* | 4/2018 | Ishiwata | H04W 72/0453 |
| 2018/0159203 | A1* | 6/2018 | Baks | H01Q 1/2283 |
| 2019/0221937 | A1 | 7/2019 | Onaka et al. | |
| 2020/0153116 | A1 | 5/2020 | Onaka et al. | |

FOREIGN PATENT DOCUMENTS

| | | | |
|---|---|---|---|
| JP | 2001-028511 | A | 1/2001 |
| JP | 2004-158555 | A | 6/2004 |
| JP | 2005-117139 | A | 4/2005 |
| WO | 2004-006384 | A1 | 1/2004 |
| WO | 2018-074377 | A1 | 4/2018 |
| WO | 2019-017075 | A1 | 1/2019 |

OTHER PUBLICATIONS

Written Opinion issued in Patent Application No. PCT/JP2018/028180 dated Oct. 16, 2018.

* cited by examiner

ANTENNA MODULE AND COMMUNICATION DEVICE

This is a continuation of International Application No. PCT/JP2018/028180 filed on Jul. 27, 2018, which claims priority from Japanese Patent Application No. 2017-176596 filed on Sep. 14, 2017. The contents of these applications are incorporated herein by reference in their entireties.

BACKGROUND OF THE DISCLOSURE

Field of the Disclosure

The present disclosure relates to an antenna module and a communication device.

Description of the Related Art

Conventionally, for example, since many patch antennas are used in an antenna module for a Massive MIMO system, a size of the antenna module is increased in a configuration in which one patch antenna has one feed point and one patch antenna corresponds to only one polarized wave. Therefore, a configuration is disclosed in which one patch antenna has two feed points (for example, Patent Document 1). As a result, one patch antenna can correspond to two polarized waves which are different in direction from each other, thereby making it possible to reduce the size of the antenna module.

Patent Document 1: Japanese Unexamined Patent Application Publication (Translation of PCT Application) No. 2000-508144

BRIEF SUMMARY OF THE DISCLOSURE

There are problems in which harmonic waves, or the like of a radio frequency signal used in an antenna module are outputted from a patch antenna, and an interference wave received by the patch antenna is inputted to a low noise amplifier (LNA) to saturate the LNA. On the contrary, it is conceivable to provide a filter for attenuating the unwanted waves such as harmonic waves or interference waves between the patch antenna and a radio frequency circuit element (for example, RFIC). However, the filter is required to correspond to each of two feed points of one patch antenna. Therefore, depending on the arrangement of the two filters in the antenna module, a size of the antenna module is increased.

The present disclosure has been made to solve the above problems, and it is an object of the present disclosure to reduce a size of an antenna module or the like including a patch antenna having two feed points.

An antenna module according to an aspect of the present disclosure includes a multilayer substrate having a first main surface and a second main surface opposing to each other, a patch antenna formed on a side of the first main surface of the multilayer substrate and configured with a radiation electrode and a ground electrode, a radio frequency circuit element formed on a side of the second main surface of the multilayer substrate, a first filter, and a second filter different from the first filter, wherein the patch antenna has a first feed point and a second feed point provided at different positions in the radiation electrode, the first feed point is electrically connected to the radio frequency circuit element via the first filter, the second feed point is electrically connected to the radio frequency circuit element via the second filter, and the first filter and the second filter are formed in the multilayer substrate.

According to this configuration, since the two filters that are the first filter and the second filter are not provided separately from the multilayer substrate and are formed in the multilayer substrate, with the filters corresponding to the respective two feed points provided, a size of the antenna module including the patch antenna having the two feed points can be reduced. Further, since the first filter and the second filter provided in a path connecting the radio frequency circuit element formed on the side of the second main surface and the patch antenna formed on the side of the first main surface are formed in the multilayer substrate, it is not necessary to extend wiring on the surface of the multilayer substrate, a wiring length of the path can be reduced, and a wiring loss can be suppressed.

Also, a direction of a polarized wave formed by the first feed point and a direction of a polarized wave formed by the second feed point may be different from each other.

According to this configuration, one patch antenna can correspond to two polarized waves which are different in direction from each other, and it is not necessary to provide a patch antenna for each polarized wave, so that it is possible to miniaturize the antenna module.

In addition, pass bands of the first filter and the second filter may at least partially overlap, and a radio frequency signal having the same frequency band may be fed to each of the first feed point and the second feed point.

According to this configuration, the first filter and the second filter have substantially the same filter characteristics, the radio frequency signal having the same frequency band can pass through each of the two feed points, and unwanted waves which may be transmitted and received can be similarly attenuated. Therefore, the antenna module can be applied to a MIMO system which is a system configured to process signals passing through a plurality of signal paths in the same manner.

In a plan view of the multilayer substrate, the patch antenna and the first filter may at least partially overlap each other, and the patch antenna and the second filter may at least partially overlap each other.

According to this configuration, the size of the antenna module in a plan view of the multilayer substrate can be made smaller. Further, wiring can be provided directly below from the patch antenna to the first filter, and wiring can be provided directly below from the patch antenna to the second filter, so that the wiring loss can be further suppressed.

In addition, in a plan view of the multilayer substrate, the patch antenna, the first filter, and the radio frequency circuit element may at least partially overlap one another, and at least the patch antenna, the second filter, and the radio frequency circuit element may at least partially overlap with one another.

According to this configuration, the size of the antenna module in a plan view of the multilayer substrate can be made smaller. Also, wiring can be provided directly below from the patch antenna to the first filter and from the first filter to the radio frequency circuit element respectively, and wiring can be provided directly below from the patch antenna to the second filter and from the second filter to the radio frequency circuit element respectively, so that the wiring loss can be further suppressed.

In addition, in a cross-sectional view of the multilayer substrate, the first filter and the second filter may be formed between the patch antenna and the radio frequency circuit element.

Since the ground electrode functions as a ground conductor of the radiation electrode, it is preferable that another conductor or the like be not provided between the radiation electrode and the ground electrode. In contrast, in the cross-sectional view, the radiation electrode and the ground electrode configuring the patch antenna, the first filter and the second filter, and the radio frequency circuit element are arranged in the order from the first main surface toward the second main surface. That is, since the first filter and the second filter are not provided between the radiation electrode and the ground electrode configuring the patch antenna as the other conductor or the like described above, the deterioration in antenna characteristics can be suppressed.

In addition, in a plan view of the multilayer substrate, the first filter may be formed in one region of two regions substantially symmetrical with respect to a center of the radiation electrode or a line passing through the center, and the second filter may be formed in the other region.

For example, since the multilayer substrate is provided with a filter for an intermediate frequency (IF) signal and the like in addition to the first filter and the second filter, when two filters are provided for one patch antenna, components (circuits) and wiring are densely packed in the multilayer substrate, thereby making it difficult to design the multilayer substrate. By contrast, since the first filter and the second filter are formed in one and the other of the two substantially symmetrical regions, the components (circuits) and wiring can be dispersed in the one region and the other region in the multilayer substrate, so that it becomes easy to design the multilayer substrate.

Further, a ground conductor may be formed between the first filter and the second filter.

According to this configuration, the isolation characteristics between the first feed point connected to the first filter and the second feed point connected to the second filter can be improved.

Further, the first filter and the second filter may be electromagnetically coupled to each other.

According to this configuration, by allowing a signal having a reverse phase with respect to a phase of an unwanted signal which leaks between the first feed point and the second feed point to flow through a coupling path between the first filter and the second filter, it is possible to cancel out the unwanted signal.

Further, the first filter and the second filter may be LC filters.

According to this configuration, it is easier to form the first filter and the second filter in the multilayer substrate. Further, the first filter and the second filter can be miniaturized.

The antenna module may include a plurality of sets of the patch antenna, the first filter, and the second filter, and the plurality of patch antennas may be arranged in a matrix shape in or on the multilayer substrate.

According to this configuration, it is possible to apply the antenna module to a Massive MIMO system.

Moreover, a communication device according to one aspect of the present disclosure includes the antenna module described above, and a baseband IC (BBIC), wherein the radio frequency circuit element is an RFIC configured to perform at least one of signal processing of a transmission system for up-converting a signal inputted from the BBIC and outputting the up-converted signal to the patch antenna, and signal processing of a reception system for down-converting a radio frequency signal inputted from the patch antenna and outputting the down-converted signal to the BBIC.

According to this configuration, it is possible to reduce a size of a communication device including a patch antenna having two feed points.

According to the antenna module or the like according to the present disclosure, it is possible to miniaturize an antenna module or the like including a patch antenna having two feed points.

DETAILED DESCRIPTION OF THE DISCLOSURE

Figure 1:
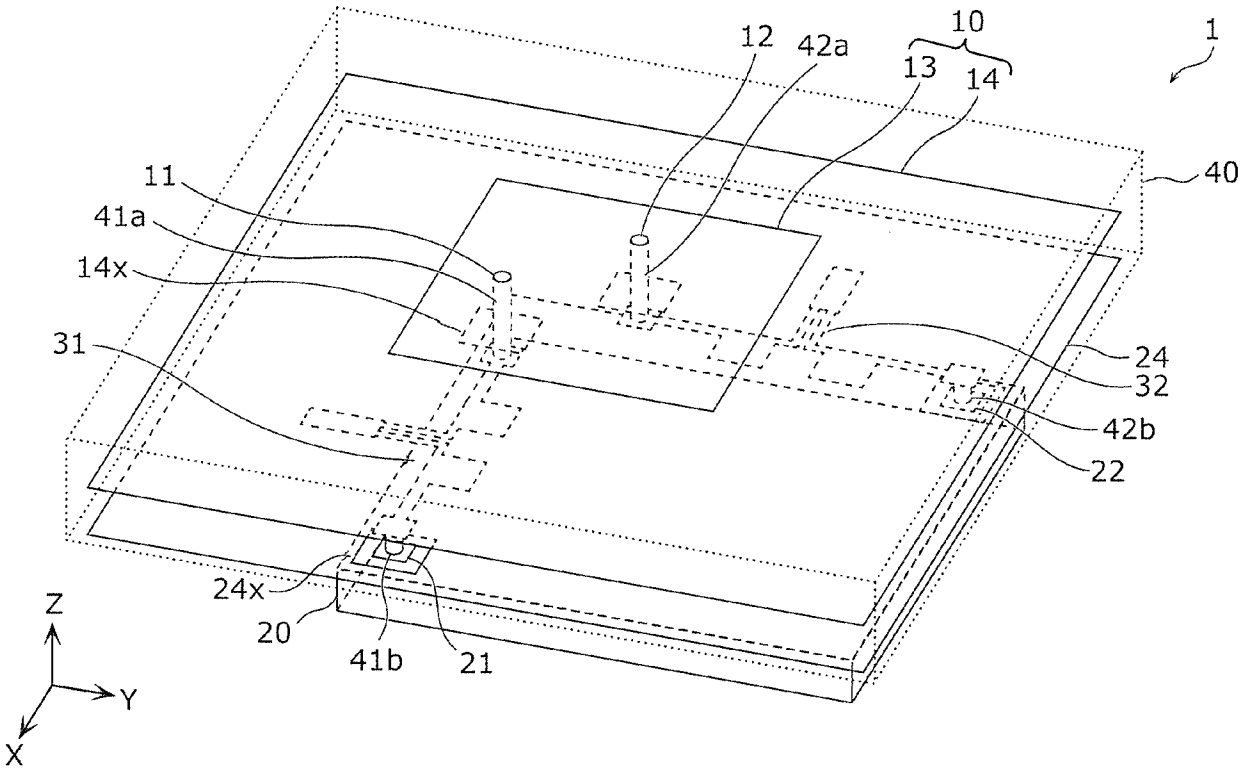
FIG. 1 is an external perspective view of an antenna module according to a first embodiment.

Hereinafter, embodiments of the present disclosure will be described in detail with reference to the accompanying drawings. The embodiments to be described below are all inclusive or specific examples. The numerical values, shapes, materials, constituent elements, arrangement and connection forms of the constituent elements shown in the following embodiments are merely examples, and are not intended to limit the present disclosure. Among the constituent elements in the following embodiments, constituent elements not described in the independent claims will be described as arbitrary constituent elements. Also, the sizes, or the ratio of sizes, of the constituent elements shown in the drawings are not necessarily exact. In the respective figures, the same reference signs are used for substantially the same configurations, and redundant description thereof will be omitted or simplified.

First Embodiment

[1. Configuration of Antenna Module]

FIG. 1 is an external perspective view of an antenna module 1 according to the embodiment.

Hereinafter, a thickness direction of the antenna module 1 will be described as a Z-axis direction, and directions perpendicular to the Z-axis direction and orthogonal to each other will be described as an X-axis direction and a Y-axis direction, and a positive side of the Z-axis direction will be described as an upper surface side of the antenna module 1.

However, in an actual use mode, since the thickness direction of the antenna module 1 may not be a vertical direction, the upper surface side of the antenna module 1 is not limited to an upper direction. The similar thing applies to the antenna modules according to the second embodiment to the fourth embodiment, and other embodiments.

The antenna module 1 shown in FIG. 1 can deal with two types of polarized waves both during transmission and during reception, and is used for, for example, full-duplex communication. In the present embodiment, the antenna module 1 deals with a polarized wave in the X-axis direction and a polarized wave in the Y-axis direction as the two types of polarized waves. That is, the antenna module 1 according to the present embodiment deals with two polarized waves orthogonal to each other. Also, the antenna module 1 is not limited to this, and may deal with two polarized waves having an angle different from the orthogonal angle (for example, 75°, 60°, or the like).

The antenna module 1 includes a multilayer substrate 40, a patch antenna 10 formed in or on the multilayer substrate 40, a first filter 31, a second filter 32, and a radio frequency circuit element (RFIC) 20.

The multilayer substrate 40 has a first main surface and a second main surface opposing to each other. The first main surface is a main surface on a positive side of the Z-axis direction of the multilayer substrate 40, and the second main surface is a main surface on a negative side of the Z-axis direction of the multilayer substrate 40. The multilayer substrate 40 has a structure in which a dielectric material is filled between the first main surface and the second main surface. In FIG. 1, the dielectric material is made transparent, an inside of the multilayer substrate 40 is visualized, and an outer shape of the multilayer substrate 40 is indicated by a broken line. As the multilayer substrate 40, a low temperature co-fired ceramics (LTCC) substrate, a printed substrate, or the like is used. In addition, as various conductors formed in or on the multilayer substrate 40, metal containing Al, Cu, Au, Ag, or an alloy thereof as a main component is used.

The patch antenna 10 is formed on the side of the first main surface of the multilayer substrate 40, and is configured with a radiation electrode 13 and a ground electrode 14 each of which is formed of a pattern conductor made of a thin film and each of which is provided parallel to the main surface of the multilayer substrate 40. For example, the radiation electrode 13 is provided on the first main surface, and the ground electrode 14 is formed at the side of the second main surface from the radiation electrode 13. The radiation electrode 13 has a rectangular shape, for example, in a plan view of the multilayer substrate 40, but may have a circular shape, a polygonal shape, or the like. The ground electrode 14 is set to a ground potential, and functions as a ground conductor of the radiation electrode 13. Further, in order to avoid oxidation or the like, the radiation electrode 13 may be formed on an inner layer of the multilayer substrate 40, or a protective film may be formed on the radiation electrode 13. Further, the radiation electrode 13 may be configured with a feed conductor and a parasitic conductor disposed above the feed conductor.

The RFIC 20 is formed on the side of the second main surface of the multilayer substrate 40, and configures an RF signal processing circuit for processing a transmission signal to be transmitted by the patch antenna 10 or a reception signal received from the patch antenna 10. The RFIC 20 has feed terminals 21 and 22 which are connected to the patch antenna 10. Further, a ground conductor 24 is formed on the side of the second main surface of the multilayer substrate 40, and for example, a ground terminal of the RFIC 20 (not shown) is connected to the ground conductor 24. In this embodiment, the RFIC 20 is provided on the second main surface of the multilayer substrate 40, but may be incorporated in the multilayer substrate 40.

The patch antenna 10 has a first feed point 11 and a second feed point 12 at which a radio frequency signal is transmitted to and from the RFIC 20. The first feed point 11 and the second feed point 12 are provided at different positions in the radiation electrode 13. A direction of a polarized wave formed by the first feed point 11 and a direction of a polarized wave formed by the second feed point 12 are different from each other, and as described above, for example, a polarized wave in the Y-axis direction is formed by the first feed point 11, and a polarized wave in the X-axis direction is formed by the second feed point 12. Thus, one patch antenna can correspond to two polarized waves. That is, since there is no need to provide a patch antenna for each polarized wave, miniaturization of the antenna module can be achieved.

The first feed point 11 is electrically connected to the RFIC 20 via the first filter 31, and the second feed point 12 is electrically connected to the RFIC 20 via the second filter 32. Specifically, the first feed point 11 is connected to the feed terminal 21 provided to the RFIC 20 with a via conductor 41*a*, the first filter 31, and a via conductor 41*b* interposed therebetween, and the second feed point 12 is connected to the feed terminal 22 provided to the RFIC 20 with a via conductor 42*a*, the second filter 32, and a via conductor 42*b* interposed therebetween.

The ground electrode 14 is provided over substantially the entire multilayer substrate 40 except for a portion where, for example, the via conductors 41*a* and 42*a* are provided when the multilayer substrate 40 is viewed in a direction of the lamination (when the multilayer substrate 40 is viewed in a plan view). The ground electrode 14 has an opening 14*x* of which the via conductors 41*a* and 42*a* pass through an inner portion. Further, the ground conductor 24 is provided over substantially the entire multilayer substrate 40 except for the portion where the via conductors 41*b* and 42*b* are provided when the multilayer substrate 40 is viewed in the direction of the lamination. The ground conductor 24 has an opening 24*x* of which the via conductors 41*b* and 42*b* pass through an inner portion.

The first filter 31 and the second filter 32 are filters such as a band pass filter, a high pass filter, or a low pass filter, and have a function of attenuating a signal in a specific frequency band. The first filter 31 and the second filter 32 are not formed integrally, but are different filters formed separately from each other. Pass bands of the first filter 31 and the second filter 32 at least partially overlap. For example, the first filter and the second filter have substantially the same filter characteristics. More specifically, the pass bands of the first filter 31 and the second filter 32 are substantially the same, and attenuation bands of the first filter 31 and the second filter 32 are substantially the same. For example, since respective radio frequency signals having the same frequency band are supplied to the first feed point 11 and the second feed point 12, the same filtering processing is performed on the respective radio frequency signals.

The first filter 31 and the second filter 32 provided between the patch antenna 10 and the RFIC 20 have functions of passing a radio frequency signal in a frequency band used by the patch antenna 10 and attenuating a radio frequency signal (unwanted wave) in other frequency bands.

Therefore, a harmonic wave can be attenuated so that the harmonic wave is not outputted from the patch antenna 10 as the unwanted wave.

Further, when an interference wave received by the patch antenna 10 as the unwanted wave is inputted to an LNA provided in the RFIC 20, the interference wave can be attenuated in order to avoid the LNA from being saturated. In this way, the unwanted wave which may be transmitted and received can be attenuated in the same manner for each of the two feed points. Therefore, the antenna module 1 can be applied to a MIMO system which is a system for processing signals that pass through a plurality of signal paths in a similar manner. As shown in FIG. 1, each of the first filter 31 and the second filter 32 is implemented with, for example, a distributed constant line, and is specifically implemented with a stub.

[2. Arrangement of First Filter and Second Filter in Multilayer Substrate]

Although the first filter 31 and the second filter 32 are formed in the multilayer substrate 40, the arrangement of the first filter 31 and the second filter 32 in the multilayer substrate 40 will be described with reference to FIG. 2.

Figure 2:
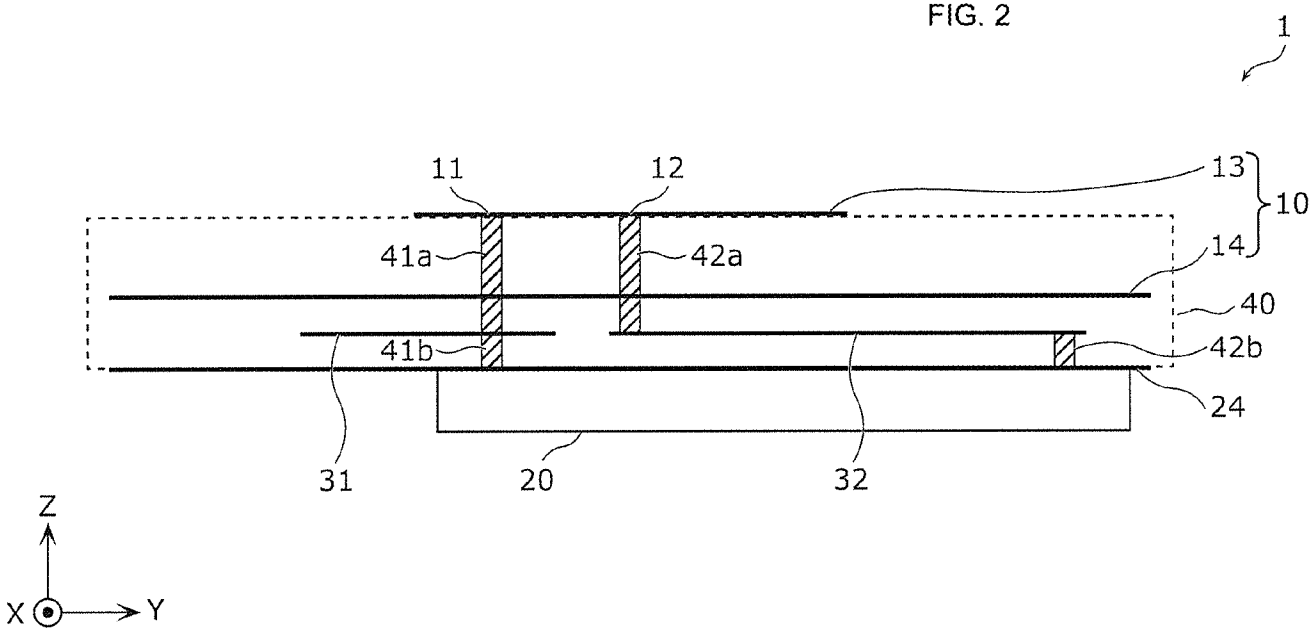
FIG. 2 is a side perspective view of the antenna module according to the first embodiment.

FIG. 2 is a side perspective view of the antenna module 1 according to the first embodiment. In FIG. 2, the dielectric material is made transparent, the inside of the multilayer substrate 40 is visualized, and the outer shape of the multilayer substrate 40 is indicated by a broken line. In FIG. 2, the via conductors 41*a*, 41*b*, 42*a* and 42*b* are hatched, but the hatching does not represent a cross section.

As shown in FIG. 1 and FIG. 2, in a plan view of the multilayer substrate 40, the patch antenna 10 and the first filter 31 at least partially overlap each other, and the patch antenna 10 and the second filter 32 at least partially overlap each other. Further, the patch antenna 10, the first filter 31, and the RFIC 20 at least partially overlap one another, and the patch antenna 10, the second filter 32, and the RFIC 20 at least partially overlap one another. In the plan view, the via conductor 41*a* is formed in a region where the patch antenna 10 and the first filter 31 overlap each other, and the via conductor 41*b* is formed in a region where the first filter 31 and the RFIC 20 overlap each other. In addition, in the plan view, the via conductor 42*a* is formed in a region where the patch antenna 10 and the second filter 32 overlap each other, and the via conductor 42*b* is formed in a region where the second filter 32 and the RFIC 20 overlap each other. In this way, since the patch antenna 10, and each of the first filter 31 and the second filter 32 at least partially overlap each other, the via conductors 41*a* and 42*a* can extend directly below from the patch antenna 10 to the first filter 31 and the second filter 32 respectively in the overlap regions. Further, since each of the first filter 31 and the second filter 32, and the RFIC 20 at least partially overlap each other, the via conductor 41*b* and the via conductor 42*b* can extend directly below from the first filter 31 and the second filter 32 to the RFIC 20 respectively in the overlap regions.

In addition, in a cross-sectional view of the multilayer substrate 40, the first filter 31 and the second filter 32 are formed between the patch antenna 10 and the RFIC 20. As described above, the patch antenna 10 includes the radiation electrode 13 and the ground electrode 14, and is also referred to as the patch antenna 10 including the dielectric material filled between the radiation electrode 13 and the ground electrode 14. That is, the fact that the first filter 31 and the second filter 32 are formed between the patch antenna 10 and the RFIC 20 means that the first filter 31 and the second filter 32 are not formed between the radiation electrode 13 and the ground electrode 14.

Also, although the first filter 31 and the second filter 32 are formed in the same layer in the multilayer substrate 40 as shown in FIG. 2, they may be formed in different layers in the multilayer substrate 40. When the first filter 31 and the second filter 32 are formed in the different layers in the multilayer substrate 40, the first filter 31 and the second filter 32 may be formed so as to at least partially overlap each other in a plan view of the multilayer substrate 40. That is, in the plan view, the patch antenna 10, the first filter 31, the second filter 32, and the RFIC 20 may at least partially overlap each other.

[3. Implementation Example of First Filter and Second Filter]

Although each of the first filter 31 and the second filter 32 is implemented with the distributed constant line as shown in FIG. 1 and FIG. 2, each of them may also be an LC filter. Hereinafter, the first filter 31 which is an LC filter will be described with reference to FIG. 3.

Figure 3:
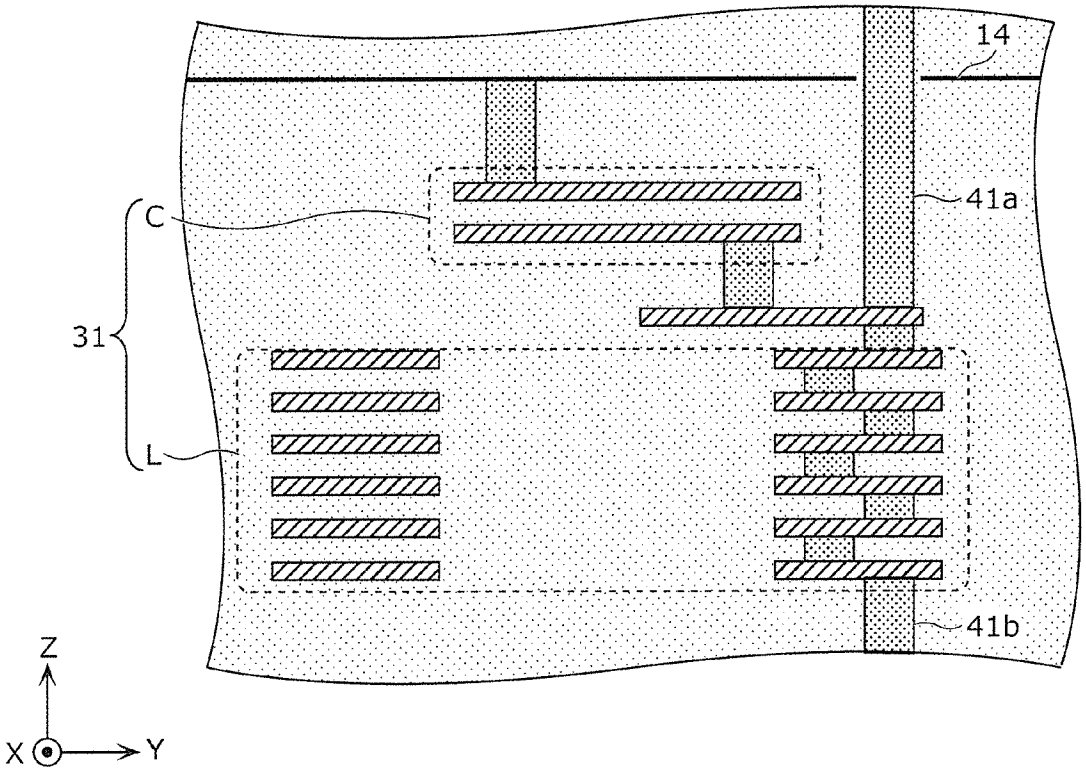
FIG. 3 is a cross-sectional view showing another example of a first filter according to the first embodiment.

FIG. 3 is a cross-sectional view showing another example of the first filter 31 according to the first embodiment. FIG. 3 schematically shows a cross section of a portion where the first filter 31 is formed in the multilayer substrate 40. In FIG. 3, for the sake of simplicity, the constituent elements in another cross section in the strict sense may be shown in the same drawing.

As shown in FIG. 3, the first filter 31 may be implemented with an inductor L and a capacitor C formed in the multilayer substrate 40. The inductor L is formed by connecting an end portion of a coil-shaped pattern conductor formed for each layer configuring the multilayer substrate 40 with via conductor. Note that the via conductor for connecting the coil-shaped pattern conductor for each layer is formed in another cross section. Additionally, the capacitor C is configured with a pair of pattern conductors facing each other. In FIG. 3, as an example of the first filter 31, a low pass filter is shown in which the inductor L is connected between the via conductor 41*a* and the via conductor 41*b*, and the capacitor C is connected between a node intervening the via conductor 41*a* and the inductor L, and the ground (ground electrode 14). Also, since the second filter 32 can be configured in the same manner as the first filter 31, the description thereof will be omitted.

[4. Effect]

As described above, since two filters that are the first filter 31 and the second filter 32 are not provided separately from the multilayer substrate 40 but are formed in the multilayer substrate 40, while including the first filter 31 and the second filter 32 which respectively correspond to the first feed point 11 and the second feed point 12, the antenna module 1 including the patch antenna 10 having the two feed points can be miniaturized. Moreover, since the first filter 31 and the second filter 32 provided in a path connecting the RFIC 20 provided on the side of the second main surface and the patch antenna 10 formed on the side of the first main surface are formed in the multilayer substrate 40, it is not necessary to extend wiring on the surface of the multilayer substrate 40, a wiring length can be reduced, and a wiring loss can be suppressed.

In addition, in a plan view of the multilayer substrate 40, the patch antenna 10 and the first filter 31 at least partially overlap each other, and the patch antenna 10 and the second filter 32 at least partially overlap each other, so that the size of the antenna module 1 in the plan view can be made smaller. Specifically, the sizes in the X-axis direction and the Y-axis direction can be reduced. Further, wiring (via conductor 41*a*) can be provided directly below from the patch antenna 10 to the first filter 31, and wiring (via conductor 42*a*) can be provided directly below from the patch antenna 10 to the second filter 32, so that the wiring loss can be further suppressed.

Further, in the plan view of the multilayer substrate 40, the RFIC 20 also at least partially overlaps with the patch antenna 10, the first filter 31, and the second filter 32, so that the size of the antenna module 1 in the plan view can be made smaller. Further, wiring (via conductors 41*a* and 41*b*) can be provided directly below from the patch antenna 10 to the first filter 31 and from the first filter 31 to the RFIC 20, and wiring (via conductors 42*a* and 42*b*) can be provided directly below from the patch antenna 10 to the second filter 32 and from the second filter 32 to the RFIC 20, so that the wiring loss can be further suppressed.

Further, although antenna characteristics may deteriorate when another conductor or the like is provided between the radiation electrode 13 and the ground electrode 14 configuring the patch antenna 10, the first filter 31 and the second filter 32 are not provided between the radiation electrode 13 and the ground electrode 14, so that the deterioration in antenna characteristics can be suppressed.

Second Embodiment

An antenna module 2 according to a second embodiment differs from the antenna module 1 according to the first embodiment in that ground via conductors 43 are formed in the multilayer substrate 40. Since the other points are the same as those of the antenna module 1 according to the first embodiment, the description thereof will be omitted.

Figure 4:
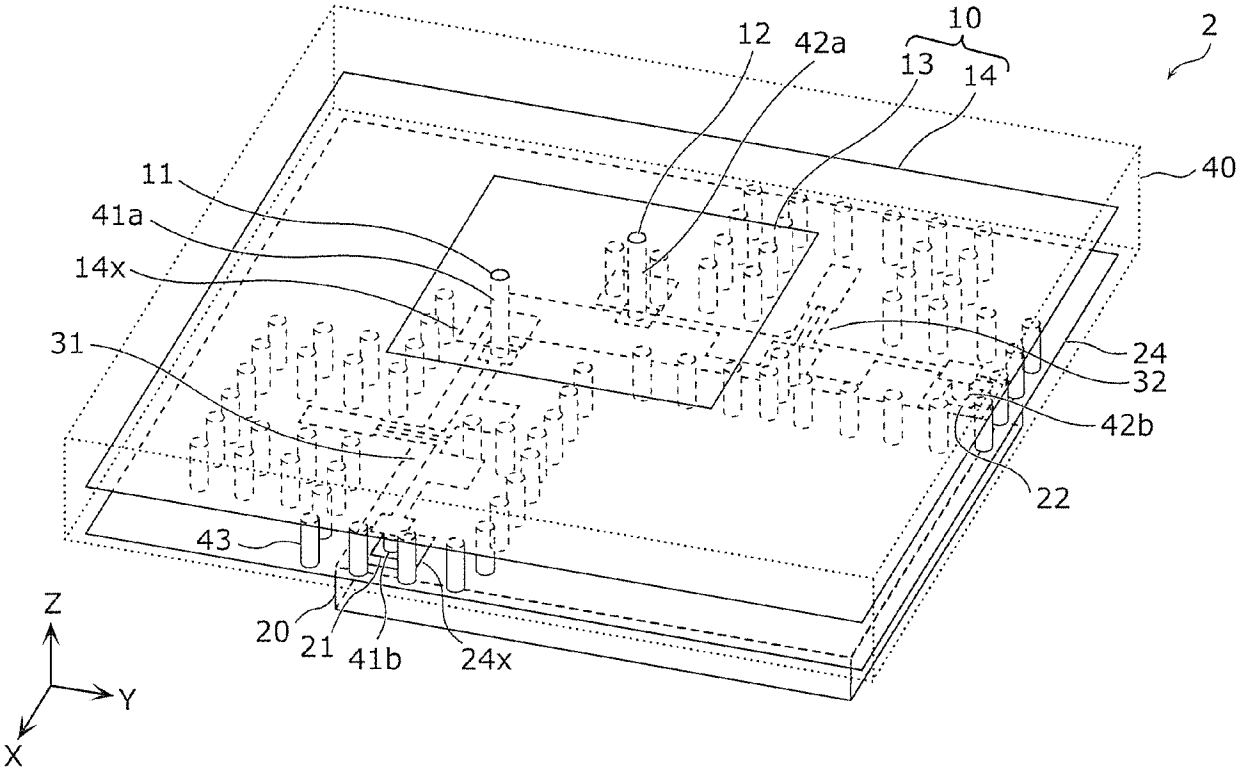
FIG. 4 is an external perspective view of an antenna module according to a second embodiment.
Figure 5:
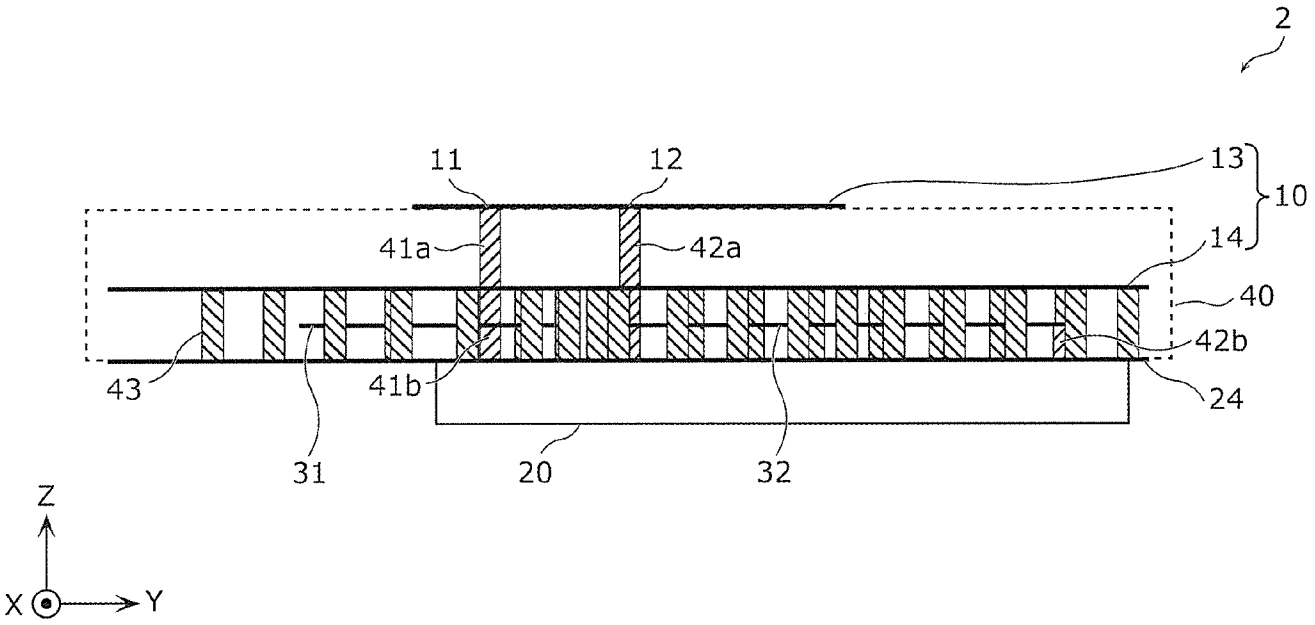
FIG. 5 is a side perspective view of the antenna module according to the second embodiment.

FIG. 4 is an external perspective view of the antenna module 2 according to the second embodiment. FIG. 5 is a side perspective view of the antenna module 2 according to the second embodiment. In FIG. 4 and FIG. 5, a dielectric material is made transparent, an inside of the multilayer substrate 40 is visualized, and an outer shape of the multilayer substrate 40 is indicated by a broken line. In FIG. 5, the via conductors 41*a*, 41*b*, 42*a*, and 42*b* and the ground via conductors 43 are hatched, but the hatching does not represent a cross section.

As shown in FIG. 4 and FIG. 5, the ground via conductors 43 are formed so as to connect the ground electrode 14 and the ground conductor 24. Further, the ground via conductors 43 surround the first filter 31 and the second filter 32, and are formed along the first filter 31 and the second filter 32. In this manner, since the first filter 31 and the second filter 32 are surrounded by the ground conductor 24, the ground electrode 14 and the ground via conductors 43, a radio frequency signal can be propagated with a low loss.

Third Embodiment

An antenna module 3 according to a third embodiment is different from the antenna module 2 according to the second embodiment in that ground via conductors 44 are formed as ground conductors in the multilayer substrate 40. Since the other points are the same as those of the antenna module 2 according to the second embodiment, the description thereof will be omitted.

Figure 6:
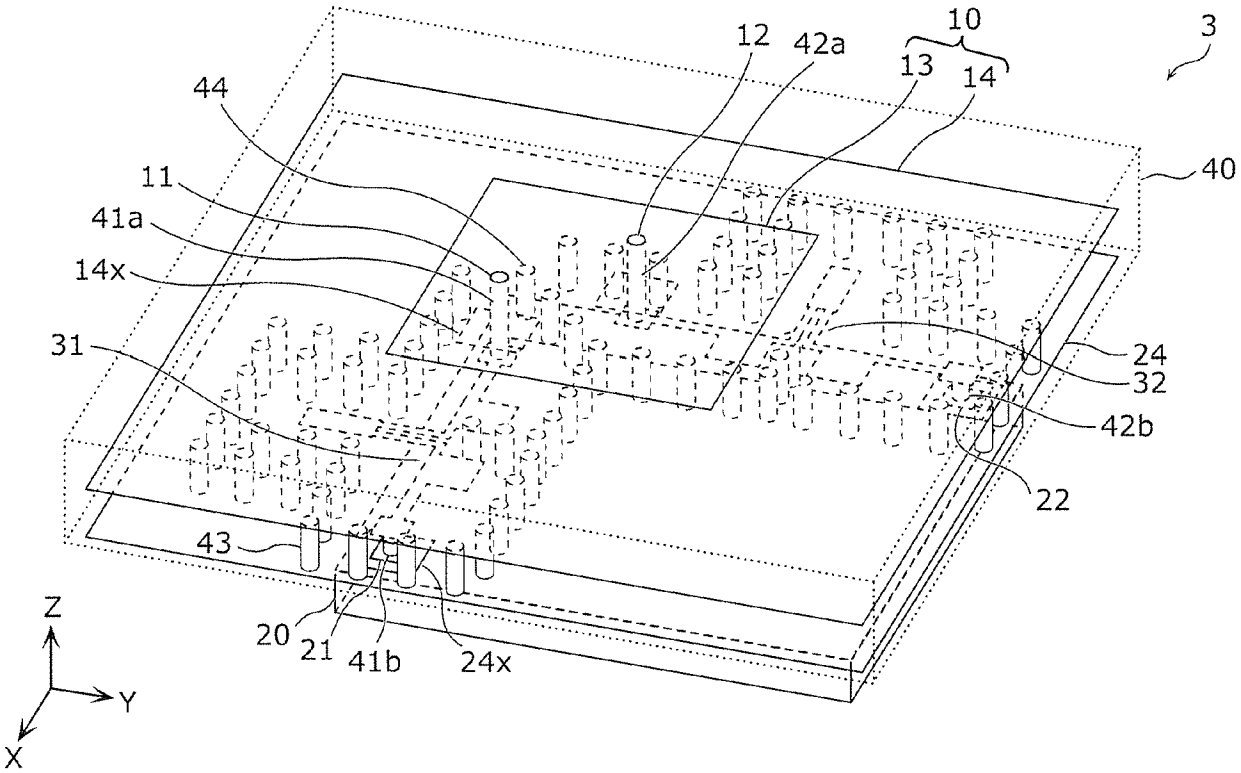
FIG. 6 is an external perspective view of an antenna module according to a third embodiment.
Figure 7:
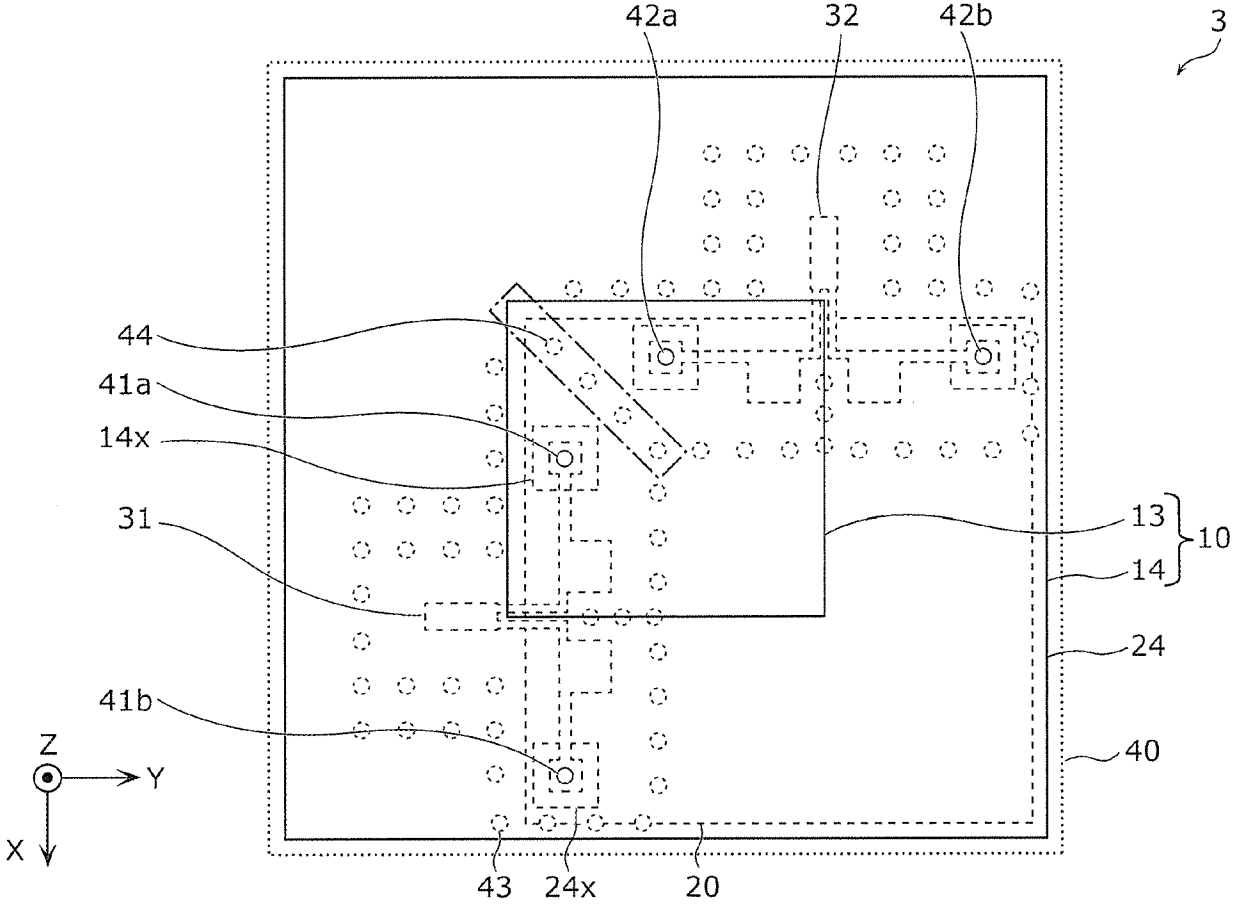
FIG. 7 is a top perspective view of the antenna module according to the third embodiment.

FIG. 6 is an external perspective view of the antenna module 3 according to the third embodiment. FIG. 7 is a top perspective view of the antenna module 3 according to the third embodiment. In FIG. 6 and FIG. 7, a dielectric material is made transparent, an inside of the multilayer substrate 40 is visualized, and an outer shape of the multilayer substrate 40 is indicated by a broken line.

As shown in FIG. 6 and FIG. 7, the ground via conductors 44 are formed between the first filter 31 and the second filter 32. Specifically, the ground via conductors 44 are formed between the first filter 31 and the second filter 32 in a plan view of the multilayer substrate 40. For example, the ground via conductors 44 are four ground via conductors surrounded by a dashed-dotted line shown in FIG. 7. Since the first filter 31 and the second filter 32 are respectively connected to the first feed point 11 and the second feed point 12 of one patch antenna, they may be formed close to each other. That is, unnecessary electromagnetic field coupling may occur between the first filter 31 and the second filter 32, and the isolation characteristics between the first feed point 11 connected to the first filter 31 and the second feed point 12 connected to the second filter 32 may deteriorate. By contrast, since the ground via conductors 44 are formed between the first filter 31 and the second filter 32, the ground via conductors 44 become a barrier to suppress the occurrence of the unnecessary electromagnetic field coupling. In this way, the isolation characteristics between the first feed point 11 and the second feed point 12 can be improved.

Note that the ground conductors formed between the first filter 31 and the second filter 32 are not limited to the via-shaped ground via conductors 44, and may be a wall-shaped ground conductor. In a case where the first filter 31 and the second filter 32 at least partially overlap each other in a plan view of the multilayer substrate 40, a ground conductor parallel to the main surface of the multilayer substrate 40 may be formed between the first filter 31 and the second filter 32 in a cross-sectional view of the multilayer substrate 40.

Fourth Embodiment

An antenna module 4 according to a fourth embodiment is different from the antenna module 1 according to the first embodiment in that a plurality of sets of the patch antenna 10, the first filter 31, and the second filter 32 described in the first embodiment to the third embodiment is included, and the plurality of patch antennas is arranged in a matrix shape in or on a multilayer substrate.

Figure 8:
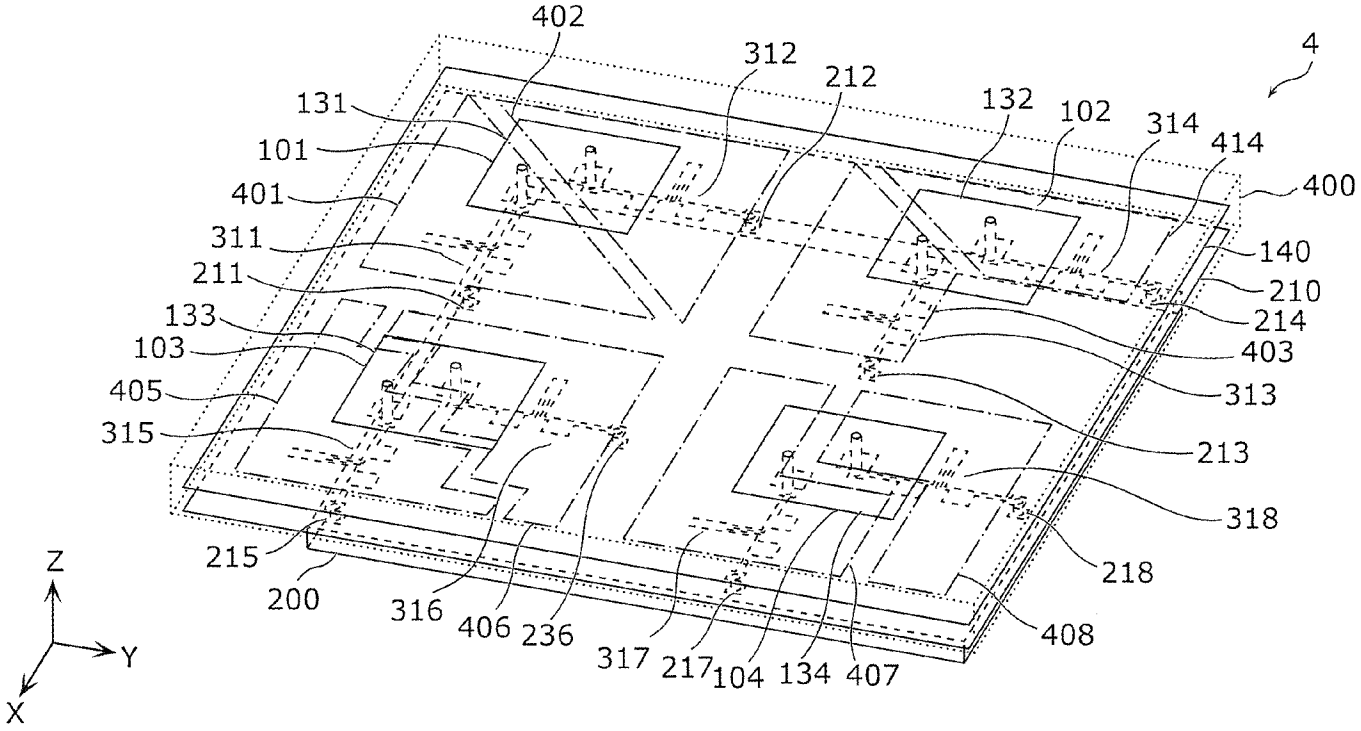
FIG. 8 is an external perspective view of an antenna module according to a fourth embodiment.

FIG. 8 is an external perspective view of the antenna module 4 according to the fourth embodiment. In FIG. 8, a dielectric material is made transparent, an inside of a multilayer substrate 400 is visualized, and an outer shape of the multilayer substrate 400 is indicated by a broken line. Patch antennas 101 to 104, first filters 311, 313, 315, and 317, second filters 312, 314, 316, and 318, the multilayer substrate 400, and an RFIC 200 according to the fourth embodiment correspond to the patch antenna 10, the first filter 31, the second filter 32, the multilayer substrate 40, and the RFIC 20 in the first embodiment to the third embodiment. Note that FIG. 8 shows a part of the multilayer substrate 400, and actually, the antenna module 4 is provided with many patch antennas in addition to the four patch antennas 101 to 104, and is applicable to the Massive MIMO system.

In the multilayer substrate 400, the patch antenna 101 is configured with a radiation electrode 131 and a ground electrode 140, the patch antenna 102 is configured with a radiation electrode 132 and the ground electrode 140, the patch antenna 103 is configured with a radiation electrode 133 and the ground electrode 140, and the patch antenna 104 is configured with a radiation electrode 134 and the ground electrode 140. Although one ground electrode 140 is formed in the multilayer substrate 400, a ground electrode may be individually formed corresponding to each of the radiation electrodes.

The plurality of patch antennas 101 to 104 is arranged periodically in a matrix shape to form an array antenna. The array antenna is configured with four patch antennas 101 to 104 which are two-dimensionally orthogonally arranged in two rows and two columns (that is, arranged in a matrix) along the X-axis direction and the Y-axis direction. Note that the number of patch antennas configuring the array antenna may be equal to or more than two. Also, an arrangement form of the plurality of patch antennas is not limited to the above. For example, the array antenna may be configured with patch antennas one-dimensionally arranged, or may be configured with patch antennas arranged in a staggered shape.

Additionally, as shown in FIG. 8, in a plan view of the multilayer substrate 400, the first filters 311, 313, 315, and 317 are formed in regions 401, 403, 405 and 407 that are one region of two regions which are substantially symmetrical with respect to a center of each of the radiation electrode 131 to 134 or a line passing through the center, and the second filters 312, 314, 316, and 318 are formed in regions 402, 404, 406, and 408 that are the other region of the two regions. In FIG. 8, a dashed-dotted line indicating each of the regions 401 to 408 is a virtual line, and such a line is not actually provided in or on the multilayer substrate 400. Shapes of the two regions may be substantially triangular as in the regions 401 and 402, or may be substantially square as in the regions 403 and 404, and sides facing each other of the two regions may be stepwise as in the regions 405 and 406, and the regions 407 and 408. Note that the shapes of the two substantially symmetrical regions are not limited to these shapes, and other shapes may also be used. Additionally, symmetry may be rotational symmetry with respect to the center of the radiation electrode 131 as a center point as in the regions 401 and 402, or may be linear symmetry with respect to the line passing through the center of the radiation electrode 132 as a center line as in the regions 403 and 404.

The multilayer substrate 400 is also provided with a filter and the like for an intermediate frequency (IF) signal in addition to the first filter and the second filter. Therefore, when two filters are provided for one patch antenna, components (circuit) and wiring are densely packed in the multilayer substrate 400, making it difficult to design the multilayer substrate 400. On the other hand, since the first filter and the second filter are respectively formed in one and the other of the two regions substantially symmetrical with each other, the components (circuit) and the wiring are dispersed in the one region and the other region in the multilayer substrate 400, so that the multilayer substrate 400 is easily designed.

Additionally, the positions of the first feed point and the second feed point of each radiation electrode are not limited to positions shown in FIG. 8. In FIG. 8, signs of the first feed point and the second feed point are omitted, a feed point positioned on a negative side of the Y-axis of each radiation electrode is the first feed point, and a feed point positioned on a negative side of the X-axis is the second feed point. For example, in the first embodiment to the third embodiment, although the position of the first feed point 11 is at the negative side of the Y-axis from the position of the second feed point 12, the position of the first feed point of the radiation electrode 132 may be at a positive side of the Y-axis from the second feed point of the radiation electrode 132, and the positions of the first feed point and the second feed point of the radiation electrode 131 and the positions of the first feed point and the second feed point of the radiation electrode 132 may be symmetrical with respect to a line. Similarly, the position of the first feed point of the radiation electrode 134 may be at the positive side of the Y-axis from the second feed point of the radiation electrode 134, and the positions of the first feed point and the second feed point of the radiation electrode 133 and the positions of the first feed point and the second feed point of the radiation electrode 134 may be symmetrical with respect to a line. Furthermore, in the first embodiment to the third embodiment, although the position of the second feed point 12 is at the negative side of the X-axis from the first feed point 11, for example, the position of the second feed point of the radiation electrode 133 may be at the positive side of the X-axis from the position of the first feed point of the radiation electrode 133, and the positions of the first feed point and the second feed point of the radiation electrode 131 and the positions of the first feed point and the second feed point of the radiating electrode 133 may be symmetrical with respect to a line. Similarly, the position of the second feed point of the radiation electrode 134 may be at the positive side of the X-axis from the position of the first feed point of the radiation electrode 134, and the positions of the first feed point and the second feed point of the radiation electrode 132 and the positions of the first feed point and the second feed point of the radiation electrode 134 may be symmetrical with respect to a line.

In this manner, by making a positional relationship between the feed points of the patch antennas adjacent to each other symmetrical with respect to a line, it is possible to suppress the deterioration of the cross polarization discrimination (XPD) due to an unwanted polarized wave in a thickness direction of the multilayer substrate 400.

Fifth Embodiment

The antenna module described above can be applied to a communication device. A communication device 60 to which the antenna module 4 according to the fourth embodiment is applied will be described below.

Figure 9:
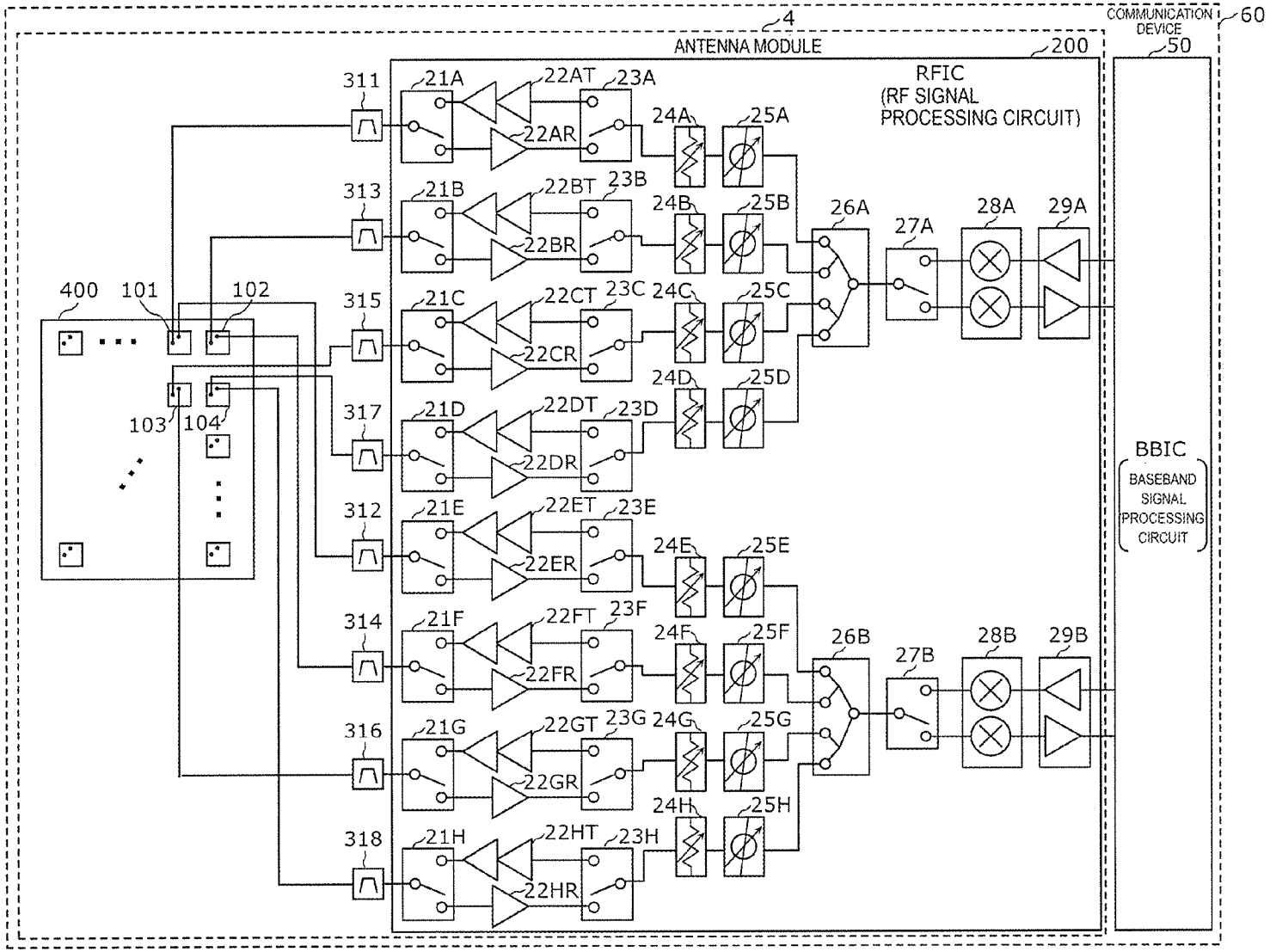
FIG. 9 is a configuration diagram showing an example of a communication device according to a fifth embodiment.

FIG. 9 is a configuration diagram showing an example of the communication device 60 according to a fifth embodiment. In FIG. 9, for the sake of simplicity, only a configuration corresponding to the four patch antennas 101 to 104 among the plurality of patch antennas included in the antenna module 4 is shown, and configurations corresponding to the other patch antennas configured in a similar manner are omitted. In addition, FIG. 9 shows a configuration of four antennas/two streams in which two streams correspond to four patch antennas.

The communication device 60 includes the antenna module 4 and a baseband IC (BBIC) 50 which configures a baseband signal processing circuit. The RFIC 200 included in the antenna module 4 performs at least one of the signal processing of a transmission system for up-converting a signal inputted from the BBIC 50 and outputting the up-converted signal to the patch antenna, and the signal processing of a reception system for down-converting a radio frequency signal inputted from the patch antenna and outputting the down-converted signal to the BBIC 50. In the present embodiment, the RFIC 200 performs both the signal processing in the transmission system and the signal processing in the reception system.

The RFIC 200 includes switches 21A to 21H, 23A to 23H, and 27A and 27B, power amplifiers 22AT to 22HT, low noise amplifiers 22AR to 22HR, attenuators 24A to 24H, phase shifters 25A to 25H, signal multiplexers/demultiplexers 26A and 26B, mixers 28A and 28B, and amplifier circuits 29A and 29B.

For each stream, signals transmitted from the BBIC 50 are amplified by the amplifier circuits 29A and 29B and are up-converted by the mixers 28A and 28B. The transmission signals which are the up-converted radio frequency signal are demultiplexed to eight signals by the signal multiplexers/demultiplexers 26A and 26B, and the eight demultiplexed signals pass through eight signal paths, and are fed to the patch antennas 101 to 104. At this time, by individually adjusting a degree of phase shift of each of the phase shifters 25A to 25H arranged in respective signal paths, it becomes possible to adjust directivity of the array antenna configured with the patch antennas 101 to 104.

The reception signals which are radio frequency signals received by the patch antennas 101 to 104 are multiplexed by the signal multiplexers/demultiplexers 26A and 26B through eight different signal paths, and the multiplexed signals are down-converted by the mixers 28A and 28B, are amplified by the amplifier circuits 29A and 29B, and are transmitted to the BBIC 50.

The RFIC 200 is formed as, for example, one chip integrated circuit component including the circuit configuration described above.

Each of the switches 21A to 21H, 23A to 23H, and 27A and 27B switches between a signal path on a transmission side and a signal path on a reception side in accordance with a control signal inputted from a control unit such as the BBIC 50. The communication device 60 shown in FIG. 9 configured as described above is compatible with a TDD system for transmitting a transmission signal and receiving a reception signal at different timings.

A communication system with which the antenna module 4 and the communication device 60 are compatible is not limited to this. For example, the antenna module 4 and the communication device 60 may be compatible with a system of simultaneously performing transmission and reception such as a PDD system, or an FDD system. That is, the plurality of patch antennas may transmit a transmission signal and receive a reception signal at the same time. In particular, since the antenna module 4 can deal with two types of polarized waves both during transmission and during reception, it is useful as an antenna module with high communication quality to be used for full-duplex communication compatible with dual polarization.

It should be noted that any of the switches 21A to 21H, 23A to 23H, and 27A and 27B, the power amplifiers 22AT to 22HT, the low noise amplifiers 22AR to 22HR, the attenuators 24A to 24H, the phase shifters 25A to 25H, the signal multiplexers/demultiplexers 26A and 26B, the mixers 28A and 28B, and the amplifier circuits 29A and 29B may not be provided in the RFIC 200. Also, the RFIC 200 may have only either the transmission paths or the reception paths. Moreover, the communication device 60 is applicable not only to a system of transmitting and receiving radio frequency signals in a single frequency band (band) but also to a system of transmitting and receiving radio frequency signals in a plurality of frequency bands (multiband).

One of the antenna modules 1 to 4 is applied to the communication device 60 having the above configuration to reduce a size of the communication device 60.

Other Embodiments

Although the antenna modules according to the embodiments of the present disclosure have been described above by using the above embodiments, the present disclosure is not limited to the above embodiments. Other embodiments which are implemented by combining arbitrary constituent elements in the above embodiments and modifications which can be obtained by implementing various deformations on the above embodiments conceived by a person skilled in the art without departing from the spirit of the present disclosure are also included in the present disclosure.

For example, in the above embodiments, the patch antenna 10 has one feed point in order to form one polarized wave, but is not limited thereto. For example, the patch antenna 10 may have two feed points in order to form one polarized wave. This will be described with reference to FIG. 10.

Figure 10:
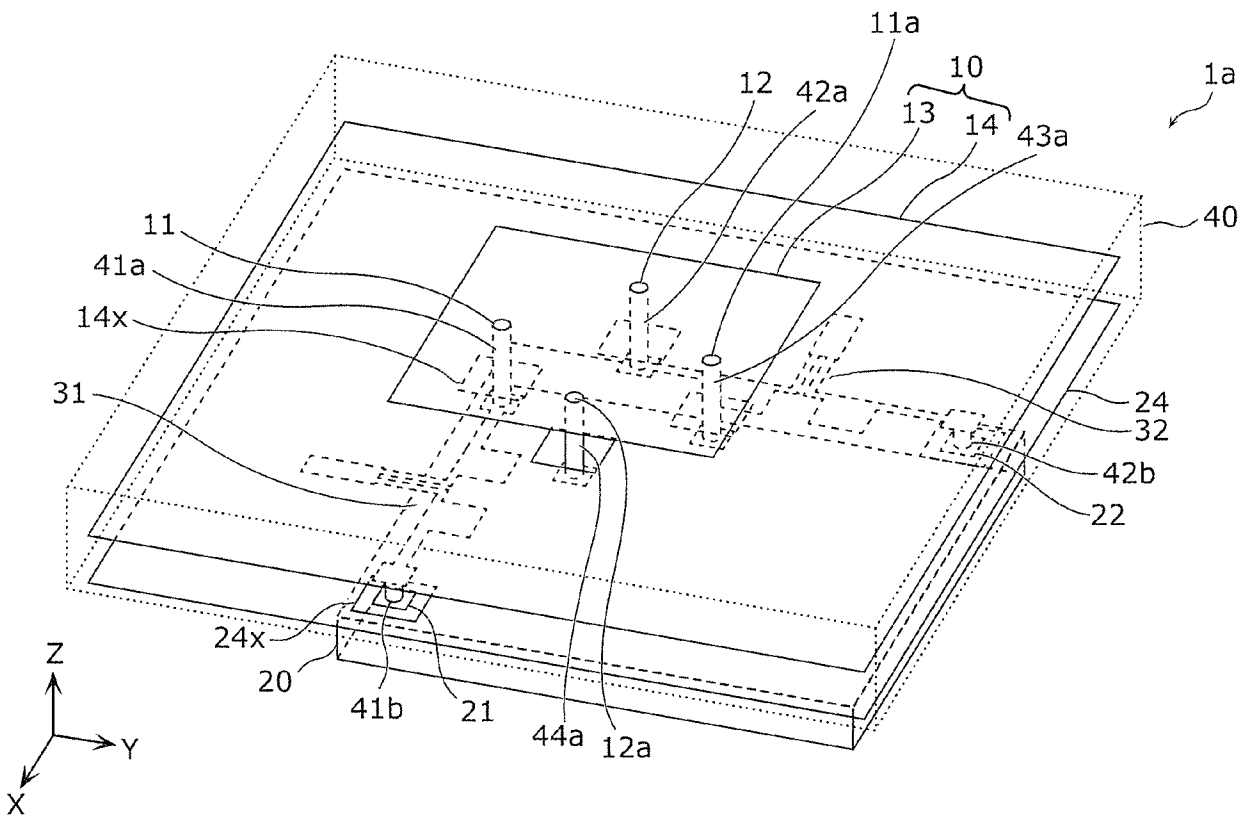
FIG. 10 is an external perspective view of an antenna module according to other embodiments.

FIG. 10 is an external perspective view of an antenna module 1*a* according to other embodiments.

The antenna module 1*a* according to other embodiments is different from the antenna module 1 according to the first embodiment in that the patch antenna 10 has two feed points for forming a polarized wave in the X-axis direction and two feed points for forming a polarized wave in the Y axis direction. Since the other points are the same as those of the antenna module 1 according to the first embodiment, the description thereof will be omitted.

The patch antenna 10 has the first feed point 11, the second feed point 12, a third feed point 11*a*, and a fourth feed point 12*a* through which a radio frequency signal is transmitted to and from the RFIC 20. These feed points are provided at different positions in the radiation electrode 13. The first feed point 11 and the third feed point 11*a* are connected to each other to form a polarized wave in the Y-axis direction, and the second feed point 12 and the fourth feed point 12*a* are connected to each other to form a polarized wave in the X-axis direction. In FIG. 10, the connection between the first feed point 11 and the third feed point 11*a*, and the connection between the second feed point 12 and the fourth feed point 12*a* are not shown.

For example, a first pattern conductor connecting the first feed point 11 and the third feed point 11*a* is provided in the inner layer of the multilayer substrate 40. For example, by connecting the via conductor 41*a* connected to the first feed point 11 and a via conductor 43*a* connected to the third feed point 11*a* by using the first pattern conductor, the first feed point 11 and the third feed point 11*a* are connected to each other. The first pattern conductor is a path that is branched from a path extending from the first filter 31 to the via conductor 41*a* and that reaches the via conductor 43*a*. The first pattern conductor is provided on a layer different from a second pattern conductor to be described later in the multilayer substrate 40, for example. By adjusting a pattern length of the first pattern conductor, the third feed point 11*a* is fed with a phase difference of 180 degrees from the first feed point 11.

Additionally, for example, a second pattern conductor connecting the second feed point 12 and the fourth feed point 12*a* is provided in the inner layer of the multilayer substrate 40. For example, by connecting the via conductor 42*a* connected to the second feed point 12 and a via conductor 44*a* connected to the fourth feed point 12*a* by using a second pattern conductor, the second feed point 12 and the fourth feed point 12*a* are connected to each other. The second pattern conductor is a path that is branched from a path extending from the second filter 32 to the via conductor 42*a* and that reaches the via conductor 44*a*. By adjusting a pattern length of the second pattern conductor, the fourth feed point 12*a* is fed with a phase difference of 180 degrees from the second feed point 12.

In this manner, a polarized wave in the Y-axis direction is formed by the first feed point 11 and the third feed point 11*a* which are fed with the phase difference of 180 degrees, and a polarized wave in the X-axis direction is formed by the second feed point 12 and the fourth feed point 12*a* which are fed with the phase difference of 180 degrees. That is, since each polarized wave is fed with the phase difference of 180 degrees, the deterioration of the XPD due to an unwanted polarized wave in the thickness direction of the multilayer substrate 40 can be suppressed.

Also, the third feed point 11*a* is connected to the first feed point 11 connected to the first filter 31, and the fourth feed point 12*a* is connected to the second feed point 12 connected to the second filter 32. That is, since a new filter is not necessarily provided for the third feed point 11*a* and the fourth feed point 12*a*, and it is sufficient that one filter is provided for each polarized wave, it is possible to miniaturize the antenna module 1*a* even when one polarized wave is formed by a plurality of feed points.

Also, for the antenna modules 2 to 4, as in the antenna module 1*a*, the patch antenna may have two feed points for each polarized wave.

Further, for example, since a ground conductor is formed between the first filter 31 and the second filter 32, the isolation characteristics between the first feed point 11 and the second feed point 12 is improved, but the electromagnetic field coupling may be positively performed by forming the first filter 31 and the second filter 32 so as to be partially closer to each other. For example, in such a manner that some of the plurality of ground via conductors 44 shown in FIG. 6 and FIG. 7 are not formed, the first filter 31 and the second filter 32 are formed in a region where the ground via conductors 44 are not formed such that the first filter 31 and the second filter 32 approach to each other. At this time, the first filter 31 and the second filter 32 are electromagnetically coupled to each other such that a signal having a reverse phase with respect to a phase of an unwanted signal leaking between the first feed point 11 and the second feed point 12 flows through the coupling path between the first filter 31 and the second filter 32. This makes it possible to cancel out the unwanted signal.

Further, for example, in a cross-sectional view of the multilayer substrate 40, the first filter 31 and the second filter 32 are formed between the patch antenna 10 and the RFIC 20, but may be formed between the radiation electrode 13 and the ground electrode 14 configuring the patch antenna 10.

Moreover, for example, in a plan view of the multilayer substrate 40, the patch antenna 10, the first filter 31, and the RFIC 20 at least partially overlap, the patch antenna 10, the second filter 32, and the RFIC 20 at least partially overlap, but they may not overlap one another.

Further, for example, the antenna modules according to the embodiments can be applied to a Massive MIMO system. One of promising radio transmission technologies for a fifth generation mobile (5G) communication system is a combination of a phantom cell and a Massive MIMO system. The phantom cell is a network configuration for separating a control signal for securing communication stability between a macro cell in a low frequency band and a small cell in a high frequency band, and a data signal to be targeted for high-speed data communication. An antenna device for Massive MIMO is provided in each phantom cell. The Massive MIMO system is a technique for improving transmission quality in a millimeter wave band or the like, and controls the directivity of an antenna by controlling a signal transmitted from each patch antenna. Also, since the Massive MIMO system uses a large number of patch antennas, a sharp directional beam can be generated. By enhancing the directivity of the beam, a radio wave can be emitted to a far distance to some extent even in a high frequency band, and the interference between the cells can be reduced to improve frequency utilization efficiency.

The present disclosure can be widely used for communication equipment such as a Massive MIMO system as an antenna module which can be miniaturized.

1, 1*a*, 2, 3, 4 ANTENNA MODULE
10, 101 TO 104 PATCH ANTENNA
11 FIRST FEED POINT
12 SECOND FEED POINT
11*a* THIRD FEED POINT
12*a* FOURTH FEED POINT
13, 131 TO 134 RADIATION ELECTRODE
14, 140 GROUND ELECTRODE
14*x*, 24*x* OPENING
20, 200 RADIO FREQUENCY CIRCUIT ELEMENT (RFIC)
21A TO 21H, 23A to 23H, 27A, 27B SWITCH
22AR TO 22HR LOW NOISE AMPLIFIER
22AT TO 22HT POWER AMPLIFIER
24A TO 24H ATTENUATOR
25A TO 25H PHASE SHIFTER
26A, 26B SIGNAL SYNTHESIZER/DEMULTIPLEXER
28A, 28B MIXER
29A, 29B AMPLIFIER CIRCUIT
21, 22, 211 TO 218 FEED TERMINAL
24, 240 GROUND CONDUCTOR
31, 311, 313, 315, 317 FIRST FILTER
32, 312, 314, 316, 318 SECOND FILTER
40, 400 MULTILAYER SUBSTRATE
41*a*, 41*b*, 42*a*, 42*b*, 43*a*, 44*a* VIA CONDUCTOR
43, 44 GROUND VIA CONDUCTOR
50 BASEBAND IC (BBIC)
60 COMMUNICATION DEVICE
401 TO 408 REGION
C CAPACITOR
L INDUCTOR

What is claimed is:

1. An antenna module comprising:
a multilayer substrate having a first main surface and a second main surface opposite to each other;
a patch antenna provided on a side of the first main surface of the multilayer substrate and configured with a radiation electrode and a ground electrode;
a radio frequency circuit element provided on a side of the second main surface of the multilayer substrate;
a first filter; and
a second filter different from the first filter, wherein
the patch antenna has a first feed point and a second feed point provided at different positions in the radiation electrode,
the first feed point is electrically connected to the radio frequency circuit element via the first filter,
the second feed point is electrically connected to the radio frequency circuit element via the second filter,
the first filter and the second filter are provided in the multilayer substrate, and
a ground conductor is provided between the first filter and the second filter.

2. The antenna module according to claim 1, wherein a direction of a polarized wave formed by the first feed point and a direction of a polarized wave formed by the second feed point are different from each other.

3. The antenna module according to claim 2, wherein pass bands of the first filter and the second filter at least partially overlap, and each radio frequency signal of a plurality of radio frequency signals in the same frequency band is fed to the first feed point and the second feed point respectively.

4. The antenna module according to claim 2, wherein in a plan view of the multilayer substrate, the patch antenna and the first filter at least partially overlap each other, and the patch antenna and the second filter at least partially overlap each other.

5. The antenna module according to claim 2, wherein in a plan view of the multilayer substrate, the patch antenna, the first filter, and the radio frequency circuit element at least partially overlap one another, and the patch antenna, the second filter, and the radio frequency circuit element at least partially overlap one another.

6. The antenna module according to claim 2, wherein in a cross-sectional view of the multilayer substrate, the first filter and the second filter are provided between the patch antenna and the radio frequency circuit element.

7. The antenna module according to claim 2, wherein in a plan view of the multilayer substrate, the first filter is provided in one region of two regions substantially symmetrical with respect to a center of the radiation electrode or a line passing through the center of the radiation electrode, and the second filter is provided in the other region.

8. The antenna module according to claim 2, wherein the ground conductor includes a plurality of via conductors.

9. A communication device comprising:

the antenna module according to claim 2; and a baseband IC (BBIC), wherein the radio frequency circuit element is an RFIC configured to perform at least one of a signal processing of a transmission system for up-converting a signal inputted from the BBIC and outputting the up-converted signal to the patch antenna, or a signal processing of a reception system for down-converting a radio frequency signal inputted from the patch antenna and outputting the down-converted signal to the BBIC.

10. The antenna module according to claim 1, wherein pass bands of the first filter and the second filter at least partially overlap, and each radio frequency signal of a plurality of radio frequency signals in the same frequency band is fed to the first feed point and the second feed point respectively.

11. The antenna module according to claim 10, wherein in a plan view of the multilayer substrate, the patch antenna, the first filter, and the radio frequency circuit element at least partially overlap one another, and the patch antenna, the second filter, and the radio frequency circuit element at least partially overlap one another.

12. The antenna module according to claim 1, wherein in a plan view of the multilayer substrate, the patch antenna and the first filter at least partially overlap each other, and the patch antenna and the second filter at least partially overlap each other.

13. The antenna module according to claim 1, wherein in a plan view of the multilayer substrate, the patch antenna, the first filter, and the radio frequency circuit element at least partially overlap one another, and the patch antenna, the second filter, and the radio frequency circuit element at least partially overlap one another.

14. The antenna module according to claim 1, wherein in a cross-sectional view of the multilayer substrate, the first filter and the second filter are provided between the patch antenna and the radio frequency circuit element.

15. The antenna module according to claim 1, wherein in a plan view of the multilayer substrate, the first filter is provided in one region of two regions substantially symmetrical with respect to a center of the radiation electrode or a line passing through the center of the radiation electrode, and the second filter is provided in the other region.

16. The antenna module according to claim 1, wherein the first filter and the second filter are electromagnetically coupled to each other.

17. The antenna module according to claim 1, wherein the first filter and the second filter are LC filters.

18. The antenna module according to claim 1, further comprising:

a plurality of sets of the patch antenna, the first filter, and the second filter, wherein the plurality of patch antennas is arranged in a matrix shape in or on the multilayer substrate.

19. A communication device comprising:

the antenna module according to claim 1; and a baseband IC (BBIC), wherein the radio frequency circuit element is an RFIC configured to perform at least one of a signal processing of a transmission system for up-converting a signal inputted from the BBIC and outputting the up-converted signal to the patch antenna, or a signal processing of a reception system for down-converting a radio frequency signal inputted from the patch antenna and outputting the down-converted signal to the BBIC.

20. The antenna module according to claim 1, wherein the ground conductor includes a plurality of via conductors.

* * * * *